US009611623B2

(12) United States Patent
Sager

(10) Patent No.: US 9,611,623 B2
(45) Date of Patent: Apr. 4, 2017

(54) APPARATUSES FOR USE WITH AN EXCAVATOR FOR SEPARATING LIQUIDS AND SOLIDS

(71) Applicant: Matthew Sager, Shawnigan Lake (CA)

(72) Inventor: Matthew Sager, Shawnigan Lake (CA)

( * ) Notice: Subject to any disclaimer, the term of this patent is extended or adjusted under 35 U.S.C. 154(b) by 41 days.

(21) Appl. No.: 14/662,103

(22) Filed: Mar. 18, 2015

(65) Prior Publication Data

US 2015/0267376 A1 Sep. 24, 2015

Related U.S. Application Data

(60) Provisional application No. 61/968,035, filed on Mar. 20, 2014, provisional application No. 62/099,647, filed on Jan. 5, 2015.

(51) Int. Cl.
*E02F 7/06* (2006.01)
*E02F 3/407* (2006.01)

(52) U.S. Cl.
CPC ..... *E02F 7/06* (2013.01); *E02F 3/407* (2013.01)

(58) Field of Classification Search
CPC ..... E02F 7/04; E02F 7/06; E02F 3/12; E02F 3/141; E02F 3/404; E02F 3/407; E02F 3/94; E02F 3/967
See application file for complete search history.

(56) References Cited

U.S. PATENT DOCUMENTS 3,395,798 A * 8/1968 Erickson ..... E02F 3/401 209/260
5,160,034 A * 11/1992 Potter ..... B07B 1/005 171/135
5,485,689 A * 1/1996 Jonninen ..... E02F 3/404 37/189
5,528,844 A * 6/1996 Ellis ..... B01D 29/05 37/403
5,732,827 A * 3/1998 Dorscht ..... B07B 1/005 209/284
5,771,612 A * 6/1998 Lynch ..... E02F 7/06 172/32
5,964,050 A * 10/1999 Svahn ..... E02F 3/40 37/403
6,135,290 A * 10/2000 Heiple ..... B07B 1/00 209/235
6,408,551 B1 * 6/2002 Pettersson ..... B07B 1/12 37/409
6,834,447 B1 * 12/2004 Currey ..... E02F 7/06 37/142.5
7,380,674 B2 * 6/2008 Vaine ..... B07B 1/00 209/420
7,591,379 B2 * 9/2009 Turnbull ..... A01K 5/001 209/235
7,743,881 B2 * 6/2010 Imamura ..... E02F 3/40 181/207
8,011,607 B1 * 9/2011 Rossi, Jr. ..... B02C 1/02 241/101.2
8,112,913 B2 * 2/2012 Sirr ..... E02F 3/404 37/379

(Continued)

*Primary Examiner* — Matthew D Troutman
*Assistant Examiner* — Adam Behrens
(74) *Attorney, Agent, or Firm* — Klarquist Sparkman, LLP

(57) ABSTRACT

Apparatuses for separating liquid from liquid-solid mixtures, particularly for use attached to excavators and in the petroleum industry. Embodiments include apparatuses for separation through compression and rotation.

10 Claims, 13 Drawing Sheets

(56) References Cited

U.S. PATENT DOCUMENTS

| | | | | |
|---|---|---|---|---|
| 8,678,195 | B2 * | 3/2014 | Azzolin | B07B 1/005 209/235 |
| 9,080,314 | B1 * | 7/2015 | Rossi, Jr. | B07B 1/46 |
| 2003/0014885 | A1 * | 1/2003 | Foutz | B07B 1/005 37/142.5 |
| 2003/0141191 | A1 * | 7/2003 | Kobayashi | B07B 13/04 205/101 |
| 2004/0244234 | A1 * | 12/2004 | Underwood | E02F 3/964 37/403 |
| 2005/0263631 | A1 * | 12/2005 | Kitsukawa | B02C 13/04 241/101.72 |
| 2006/0045714 | A1 * | 3/2006 | Risch | E02F 3/3677 414/722 |
| 2011/0099860 | A1 * | 5/2011 | Sirr | E02F 3/404 37/403 |
| 2011/0100882 | A1 * | 5/2011 | Beam | B07B 1/005 209/252 |
| 2013/0105368 | A1 * | 5/2013 | Azzolin | B07B 1/005 209/235 |

* cited by examiner

160 →

APPARATUSES FOR USE WITH AN EXCAVATOR FOR SEPARATING LIQUIDS AND SOLIDS

CROSS REFERENCE TO RELATED APPLICATIONS

This application claims the benefit of U.S. Provisional Application No. 61/968,035, filed 20 Mar. 2014 and U.S. Provisional Application No. 62/099,647, filed 5 Jan. 2015.

FIELD OF THE INVENTION

The present invention relates to apparatuses for use with an excavator for separating liquids and solids.

BACKGROUND OF THE INVENTION

Many industrial practices result in issues related to the disposal of mixtures of liquids and particulate matter. In particular, handling and disposal of liquid-solid mixtures is a significant issue in the petroleum industry, particularly with respect to drilling and well-site activity.

SUMMARY OF THE INVENTION

In one aspect, the present invention provides an apparatus for use with an excavator, the apparatus including a bucket configured to both handle and move mixtures of liquids and particulate matter and to separate liquid from such mixtures, through using a bucket like implement to scoop a substance that could contain but not limited to a liquid solid mixture. The apparatus encapsulates such mixture contained within the bucket and through vibration and compressing it causes liquid to flow through a screening device where separation of the contaminated liquid is a result.

In another aspect, the present invention provides an apparatus for use with an excavator, the apparatus including a chamber containing a rotatable perforated cylinder suitable for receiving a solid liquid mixture, wherein rotation of the cylinder causes liquid to move through the perforations so as to separate the liquid from the solids.

In another aspect, the present invention provides an apparatus for use with an excavator for separating liquid from a liquid-solid mixture, the apparatus including: an excavator bucket having a plurality of openings between the bucket interior and the bucket exterior, the openings configured to permit passage of liquid and impede passage of solids; and a pressure pad movable by a user relative to the bucket between an open position in which material may be received into, and removed from, the bucket interior, and a compressing position in which the pressure pad intrudes into the bucket interior, whereby liquid may be separated from a liquid-solid mixture located within the bucket interior, by moving the pressure pad toward the compressing position so as to compress liquid-solid mixture thereby causing liquid to flow through the openings.

The pressure pad may be hingedly connected to the excavator bucket.

The pressure pad may be movable by one or more hydraulic actuators controllable by the user. The pressure pad may be movable by a user by a hydraulic rotary actuator.

The pressure pad may include a vibrator. The vibrator may be electrically actuated. The vibrator may be hydraulically actuated.

The pressure pad may include a plurality of pressure pad openings therethrough configured to permit passage of liquid and impede passage of solids.

In another aspect, the present invention provides an apparatus for use in separating liquid from a liquid-solid mixture, the apparatus comprising: an outer housing including a collecting pan for receiving liquid; and a drum disposed within the outer housing, wherein the drum: has openings configured to permit passage of liquid and impede passage of solids, is rotatable relative to the outer housing; and has an opening for receiving material; whereby in use, liquid may be separated from a liquid-solid mixture by placing liquid-solid mixture in the drum, rotating the drum so as to cause liquid to collect in the collecting pan.

The apparatus may be configured for attachment to, and articulation with respect to, an excavator digger arm.

The apparatus may include a mixing shaft attached to the drum and comprising a curved shoulder and auger projections.

DETAILED DESCRIPTION WITH REFERENCE TO THE DRAWINGS

Figure 1:
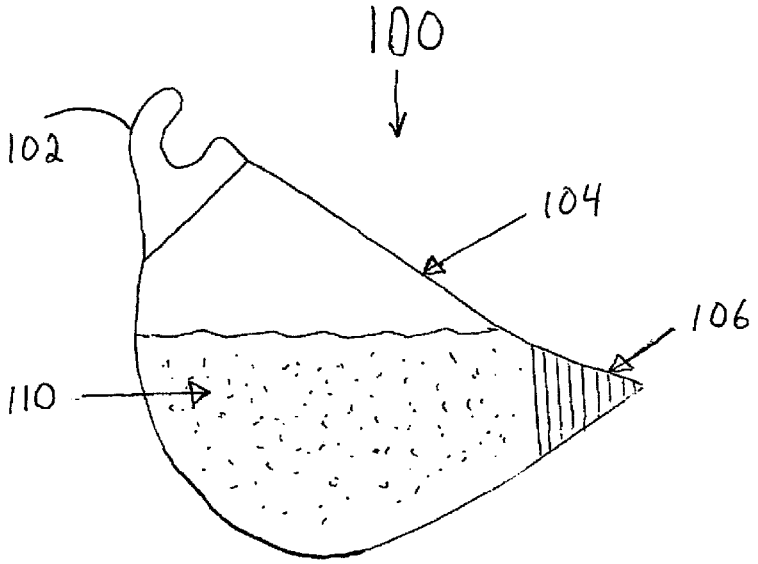
FIG. 1 is a side elevation transparent stylized view of a prior art excavator bucket.
Figure 2:
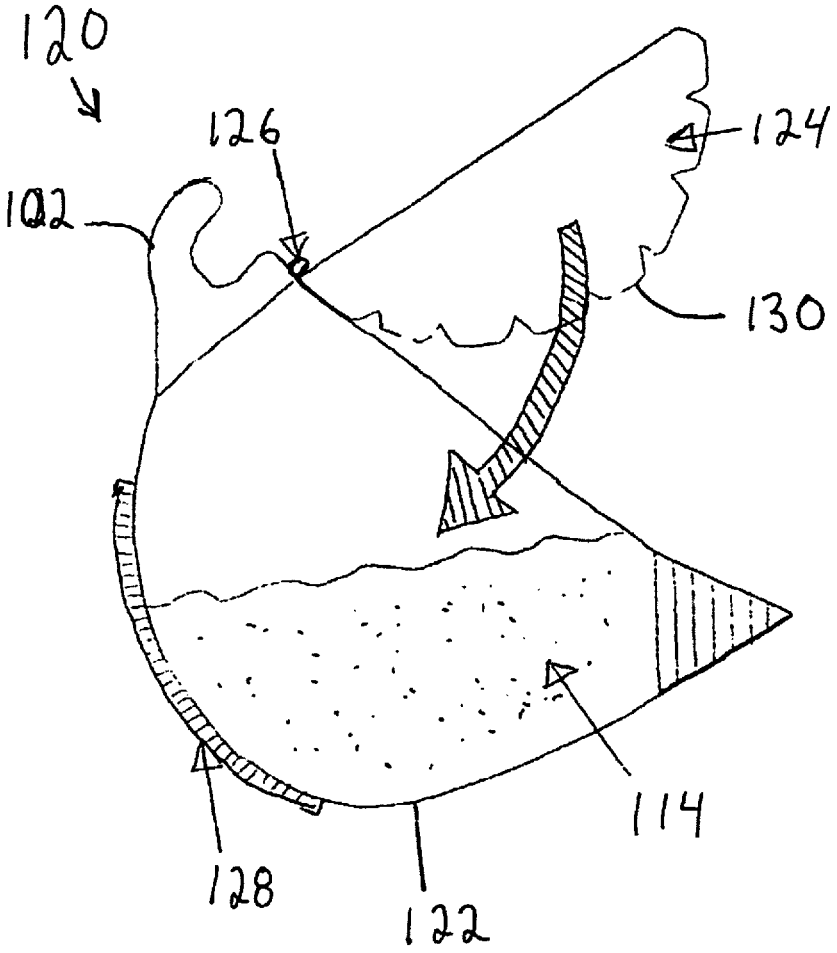
FIG. 2 is a side elevation transparent stylized view of a first bucket separator embodiment of the present invention.
Figure 3:
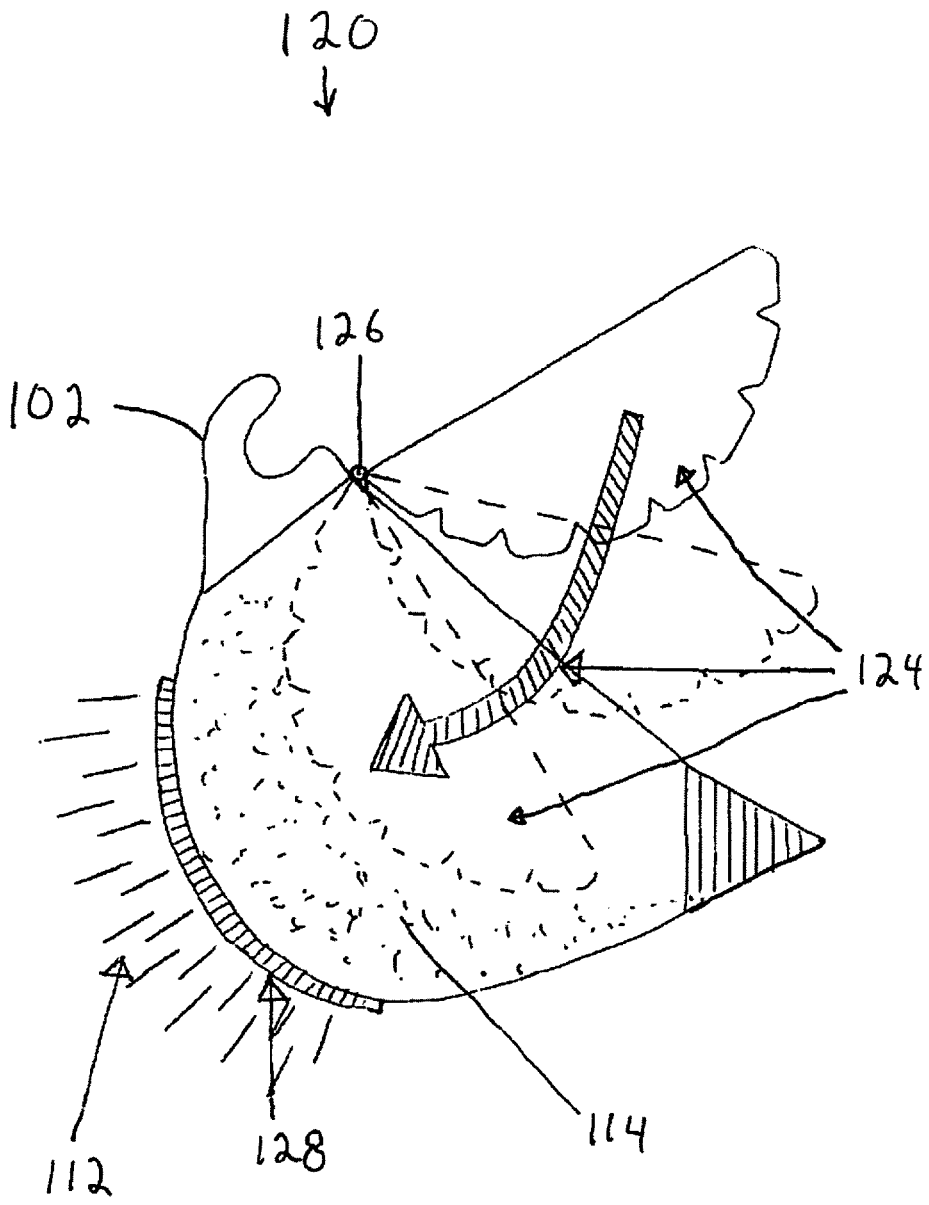
FIG. 3 is a side elevation transparent stylized view of the first bucket separator embodiment of FIG. 2, showing relative component movement during use.

As shown in the drawings, embodiments of the present invention include apparatuses for use with conventional hydraulic excavators, commonly referred to as backhoes and trackhoes.

The two main sections of a track excavator are the undercarriage and the house. The undercarriage includes the tracks, track frame, and final drives, which have a hydraulic motor and gearing providing the drive to the individual tracks, and the house includes the operator cab, counterweight, engine, fuel and hydraulic oil tanks. The house attaches to the undercarriage by way of a center pin. High pressure oil is supplied to the tracks' hydraulic motors through a hydraulic swivel at the axis of the pin, allowing the machine to slew 360° unhindered.

The main boom attaches to the house and can be one of several different configurations, but most are mono booms which only move up and down. Attached to the end of the main boom is the digger arm (or stick or dipper arm).

Generally, a conventional excavator bucket 100 (shown in FIG. 1) is attached to the distal end of the digger arm (not shown) via a digger arm connector 102. As shown in the drawings, digger arm connector 104 generally comprises two robust spaced apart hooks that matingly engage with suitably configured components on the digger arm so as to provide relative pivotal movement of the conventional excavator bucket 100 relative to the digger arm while enabling a user to relatively rapidly disengage the conventional excavator bucket 100 from the digger arm (e.g., to connect another implement to the digger arm). Typically, the conventional excavator bucket 100 is articulated relative to the digger arm by means of a hydraulic ram (not shown) interposed between digger arm and the conventional excavator bucket 100.

In addition to the digger arm connector 102, the conventional excavator bucket 100 also includes a bucket opening 104 and a blade 106. The conventional excavator bucket 100 is typically made from steel. In the usual excavating mode, the blade 106 is subject to the greatest wear and is thus usually configured to be wear resistant, e.g., by thickening and/or material selection (i.e., specially hardened steel). In FIG. 1, the conventional excavator bucket 100 is shown containing excavated material 110.

Embodiments of the present invention for separating liquid 112 from a liquid-solid mixture 114 are shown in FIGS. 2-13.

FIGS. 2 to 5 show a first bucket separator 120 embodiment of the present invention, configured for attachment to, and articulation with respect to, a digger arm in the same manner as a conventional excavator bucket 100.

The first bucket separator 120 includes, a first bucket separator bucket body 122, a curved pressure pad 124, a hinge 126 pivotally connecting the curved pressure pad 124 to the first bucket separator bucket body 122, and a backscreen 128.

The curved pressure pad 124 shown in the drawings includes a corrugated pressure surface 130 that generally corresponds to the curved inner back wall of the first bucket separator bucket body 122, so as to, in use, impart a relatively consistent force to the liquid-solid mixture 114 contained between the interior of the first bucket separator bucket body 122 and the curved pressure pad 124.

The curved pressure pad 124 and first bucket separator bucket body 122 are sized so as to provide close tolerances between the sides of the curved pressure pad 124 and the inner walls of the first bucket separator bucket body 122, so as to impede passage of solids between these components.

The backscreen 128 is sized and configured so as to permit passage of liquid 112 while impeding passage of solids.

The first bucket separator 120 preferably includes a vibrator 132 within or attached to the curved pressure pad 124. In use, the vibrator 132 agitates the liquid-solid mixture 114 which is understood to assist the flow of liquid 112 through and from the liquid-solid mixture 114. It is understood that as compared to a smooth surface, the corrugation of the corrugated pressure surface 130 assists in transmitting the vibration to the liquid-solid mixture 114.

The operation of the vibrator 132 may be controlled by the operator. Alternatively, the vibrator 132 may be configured to automatically vibrate when the curved pressure pad 124 is within a pre-defined range of positions relative to the first bucket separator bucket body 122. The vibrator 132 may be electrically actuated, or hydraulically actuated, or both electrically and hydraulically actuated.

Figure 4:
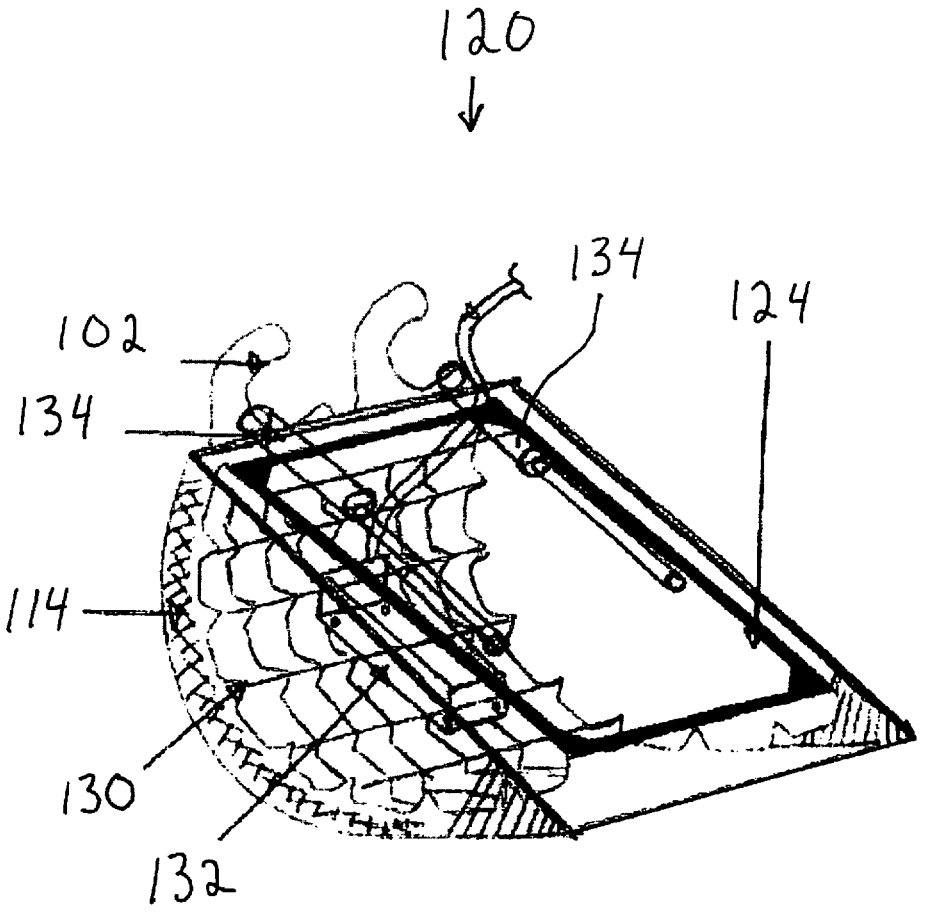
FIG. 4 is a perspective transparent stylized view of the first bucket separator embodiment of the present invention, shown with an electrically powered vibrator.
Figure 5:
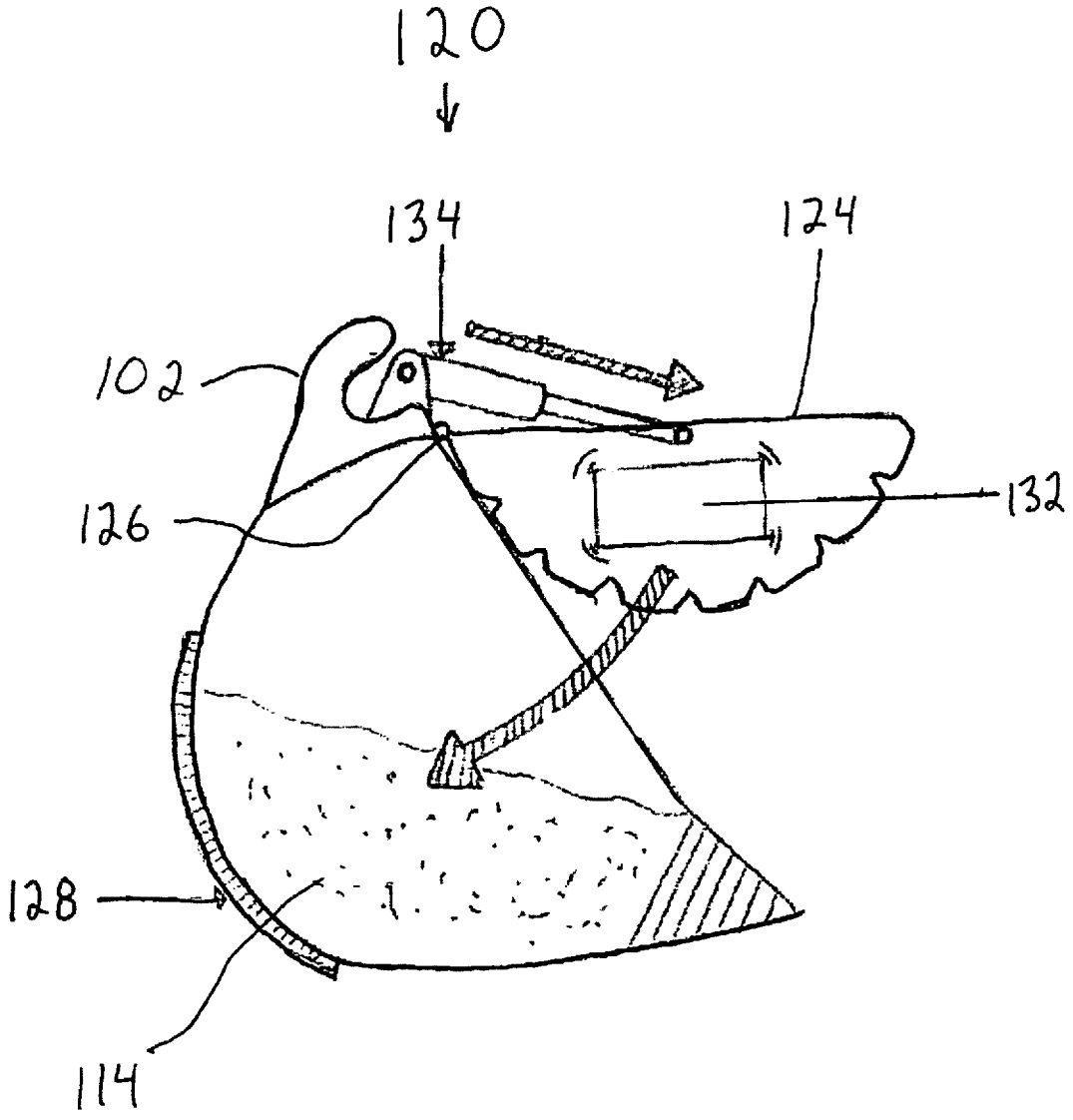
FIG. 5 is a side elevation transparent stylized view of the first bucket separator embodiment of FIG. 2, showing a vibrator.
Figure 6:
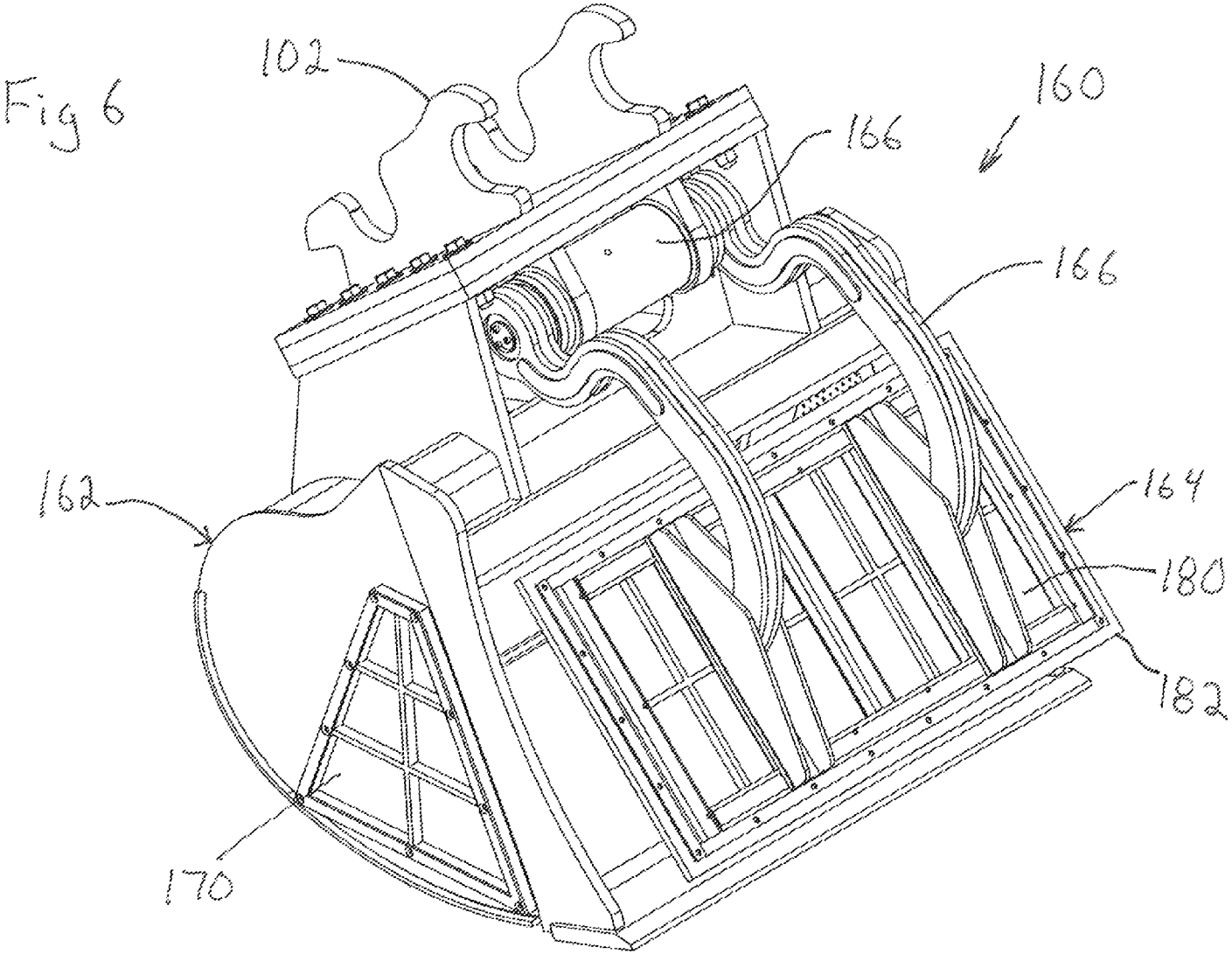
FIG. 6 is a perspective view of a second bucket separator embodiment of the present invention.

As shown in FIGS. 4 and 5, the hinged movement of the curved pressure pad 124 relative to the first bucket separator bucket body 122 may be effected by means of one or more pressure pad hydraulic rams 134 interposed between the curved pressure pad 124 and the first bucket separator bucket body 122.

Alternatively, the hinged movement of the curved pressure pad 124 relative to the first bucket separator bucket body 122 may be effected by way of a two-stage arrangement, the first stage being components configured to bring the curved pressure pad 124 to, and secure the curved pressure pad 124 in, a defined position relative to the digger arm to which the first bucket separator 120 is attached (perhaps utilizing one or more rotatable eccentric cam-like devices), and the second stage involving using the hydraulic ram interposed between the first bucket separator 120 and the digger arm to "curl" the first bucket separator 120 so as to create contact between the curved pressure pad 124 and the digger arm, thus causing the curved pressure pad 124 to move relative to the first bucket separator bucket body 122. In this arrangement the compressive force would be provided by the hydraulic ram interposed between the first bucket separator 120 and the digger arm.

FIGS. 6 to 10 show a second bucket separator 160 embodiment of the present invention, configured for attachment to, and articulation with respect to, a digger arm in the same manner as a conventional excavator bucket 100.

The second bucket separator 160 includes a second bucket separator bucket body 162, a flat pressure pad 164, two pressure pad arms 166, a rotary actuator 168, two side screens 170, a screen insert 172.

The rotary actuator 168 is preferably a high-torque, high-bearing rotary actuator. Suitable such rotary actuators are provided by the Helac Corporation.

The flat pressure pad 164 is attached to the distal end of each pressure pad arm 166. The proximal end of each pressure pad arm 166 is attached to the rotary actuator 168, such that in use, the flat pressure pad 164 moves in an arc about the axis of rotation of the rotary actuator 168.

The flat pressure pad 164 includes a pad face screen 180 configured so as to permit passage of liquid 112 through the flat pressure pad 164 while impeding passage of solids. The flat pressure pad 164 includes a gasket 182 being a gasket/sacrificial material about the periphery of the flat pressure pad 164, that in use contacts the adjacent interior surfaces of the second bucket separator bucket body 162 so as to impede passage of solids there between.

Figure 7:
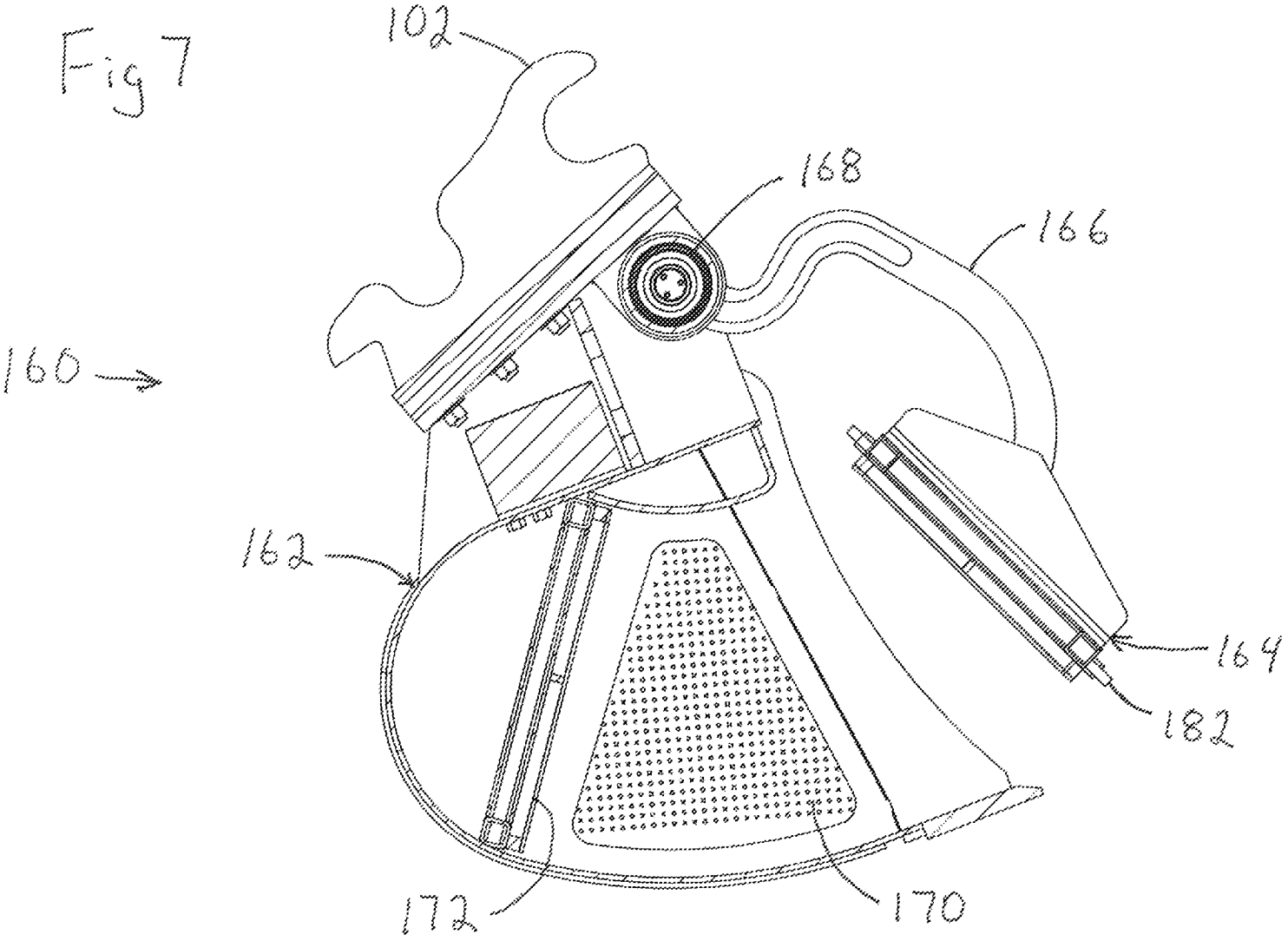
FIG. 7 is a partially sectional side elevation view of the second bucket separator embodiment of FIG. 6.
Figure 8:
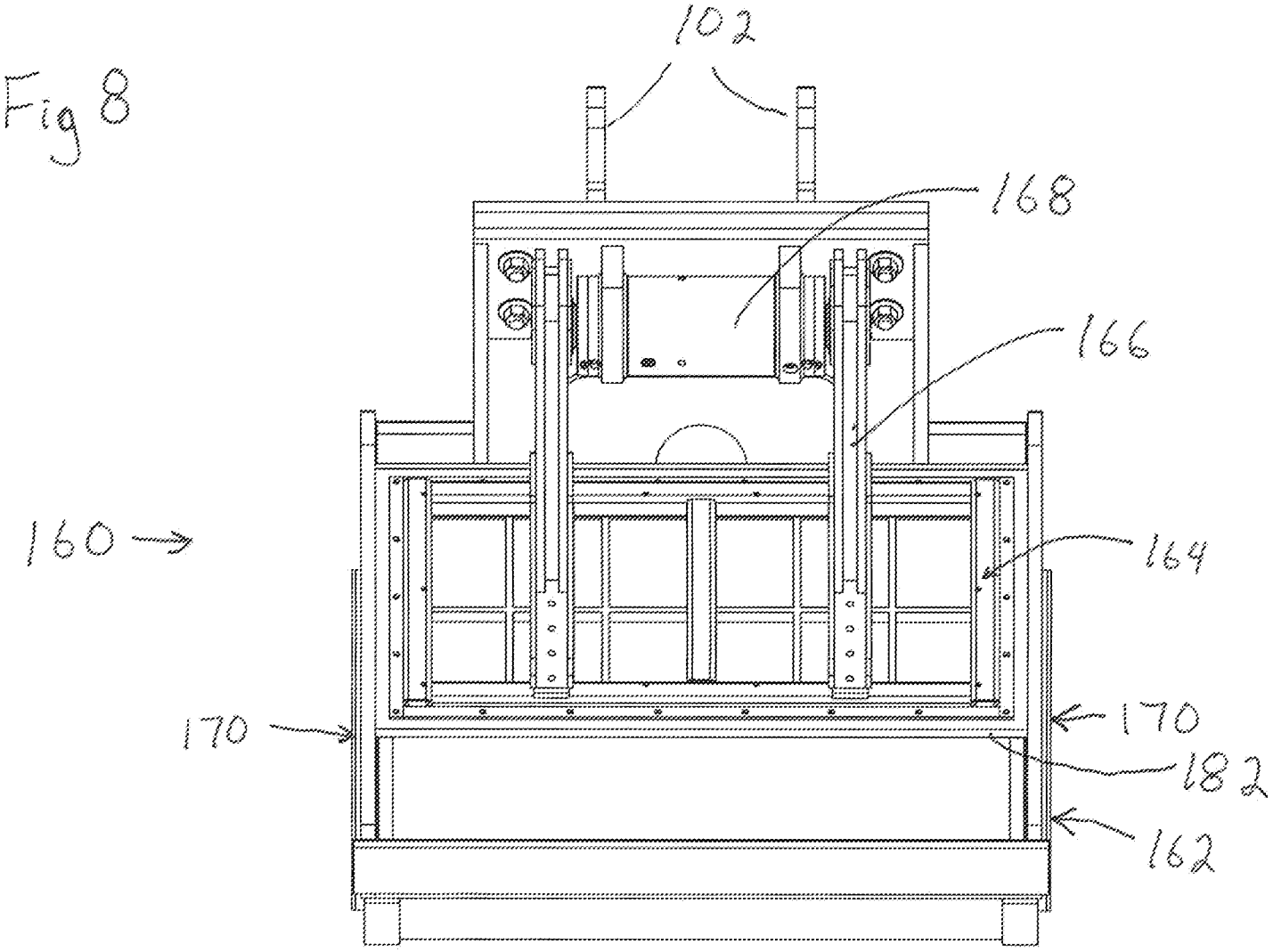
FIG. 8 is a front elevation view of the second bucket separator embodiment of FIG. 6.
Figure 9:
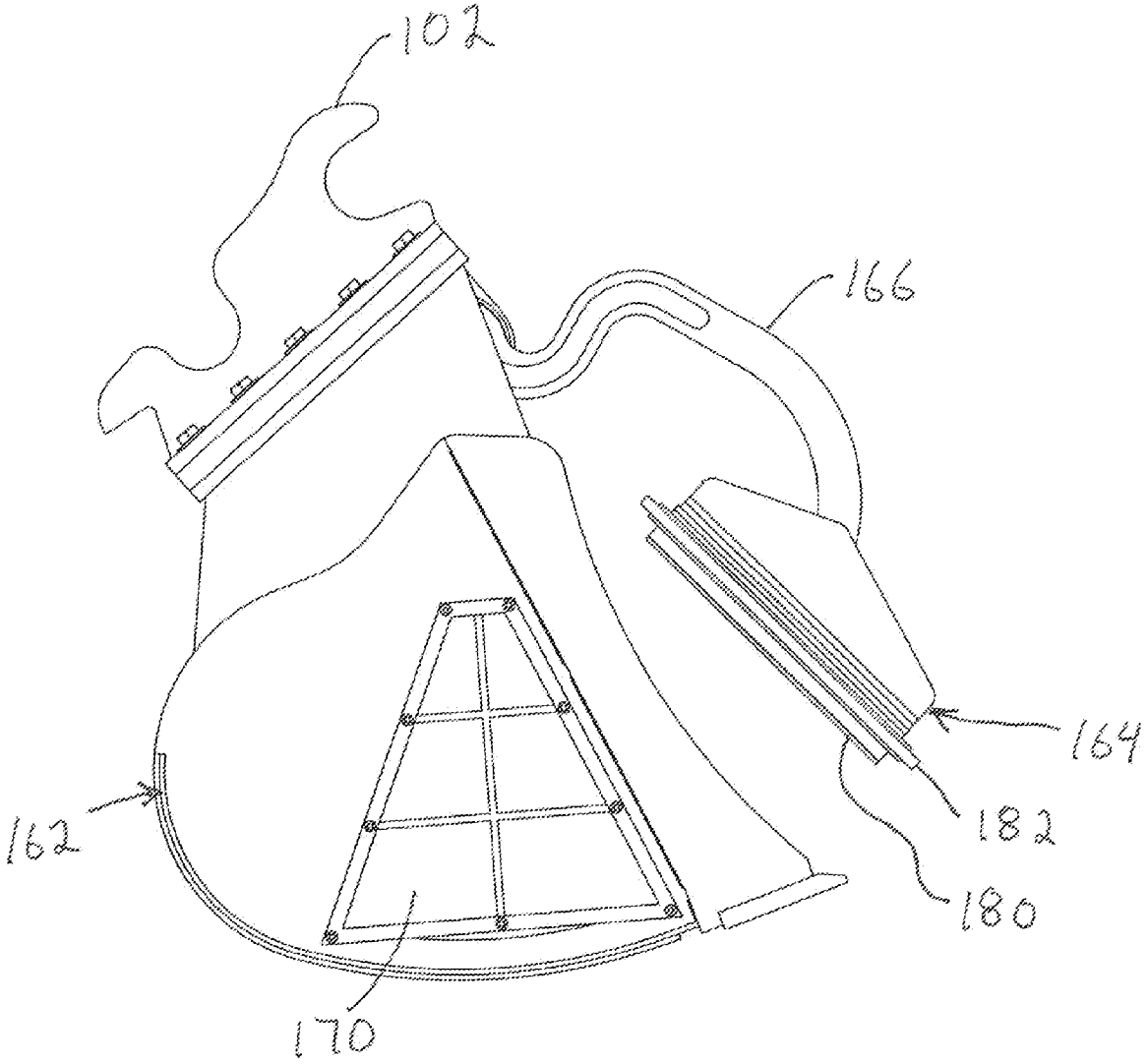
FIG. 9 is a side elevation view of the second bucket separator embodiment of FIG. 6.
Figure 10:
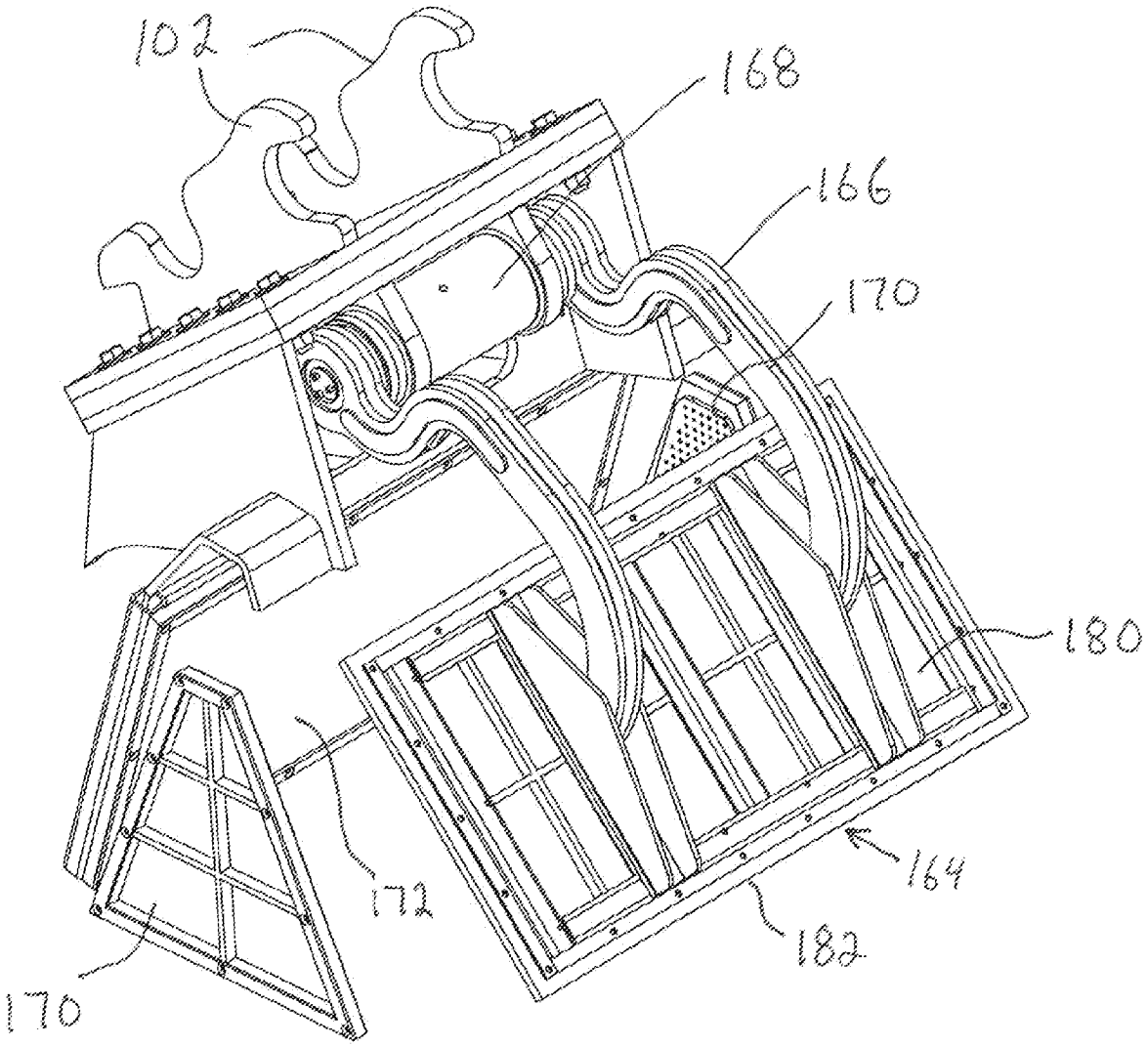
FIG. 10 is a perspective view of the second bucket separator embodiment of FIG. 6, shown as if the bucket were invisible.

As indicated in FIG. 7, the upper and lower interior surfaces of the second bucket separator bucket body 162 are curved and the arcs defined by the upper and lower interior surfaces of the second bucket separator bucket body 162 are concentric with the axis of rotation of the rotary actuator 168. Thus, a desired tight spacing between the flat pressure pad 164 and the interior surfaces of the second bucket separator bucket body 162 is maintained through the functional range of motion of the flat pressure pad 164 within the second bucket separator bucket body 162 (in terms of the application of pressure to a liquid-solid mixture 114 within the second bucket separator bucket body 162).

The two side screens 170 and screen insert 172 are configured to permit passage of liquid 112 there through while impeding passage of solids. Included in the second bucket separator 160 is means for liquid 112 that has passed through the screen insert 172 to pass to the exterior of the second bucket separator 160 (not shown).

The second bucket separator 160 may include vibration means (not shown) akin to the vibrator 132.

The general configuration of the second bucket separator 160, notably there being four screens (i.e., the two side screens 170, screen insert 172 and pad face screen 180), facilitates the flow of liquid 112 from a liquid-solid mixture 114 under pressure within the second bucket separator 160.

Figure 11:
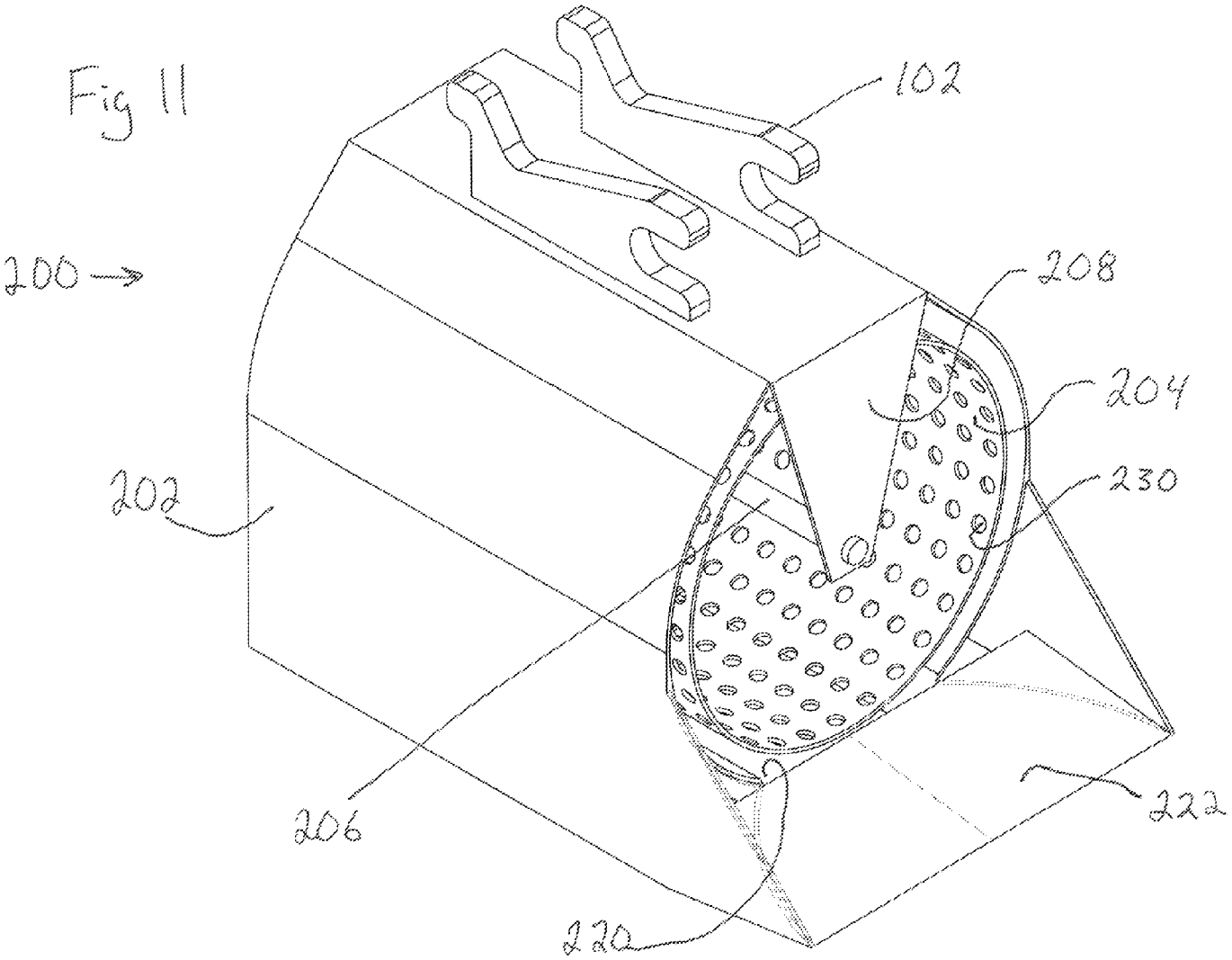
FIG. 11 is a perspective view of a rotary separator embodiment of the present invention.
Figure 12:
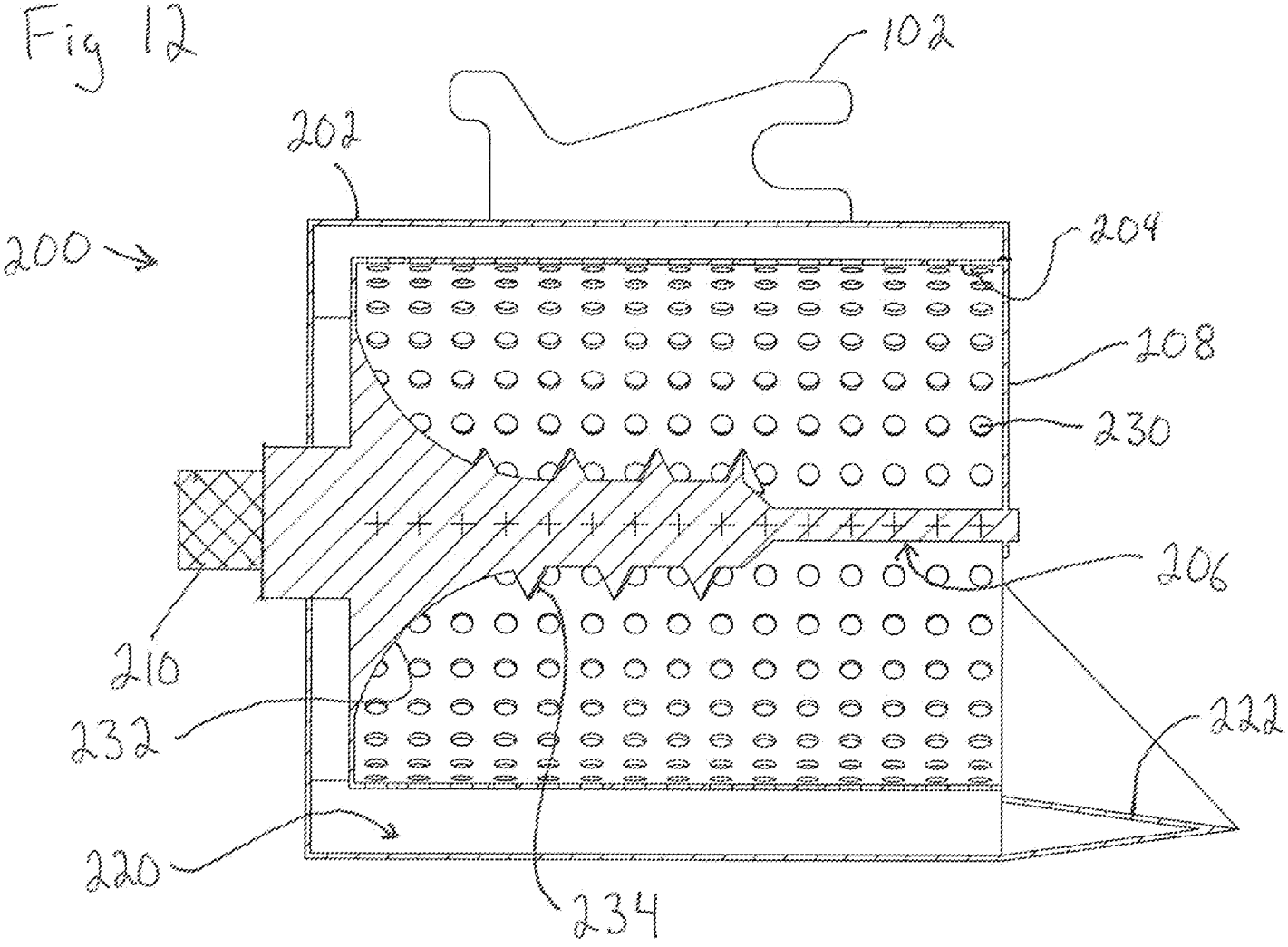
FIG. 12 is a partially sectional side elevation view of the rotary separator embodiment of FIG. 11.
Figure 13:
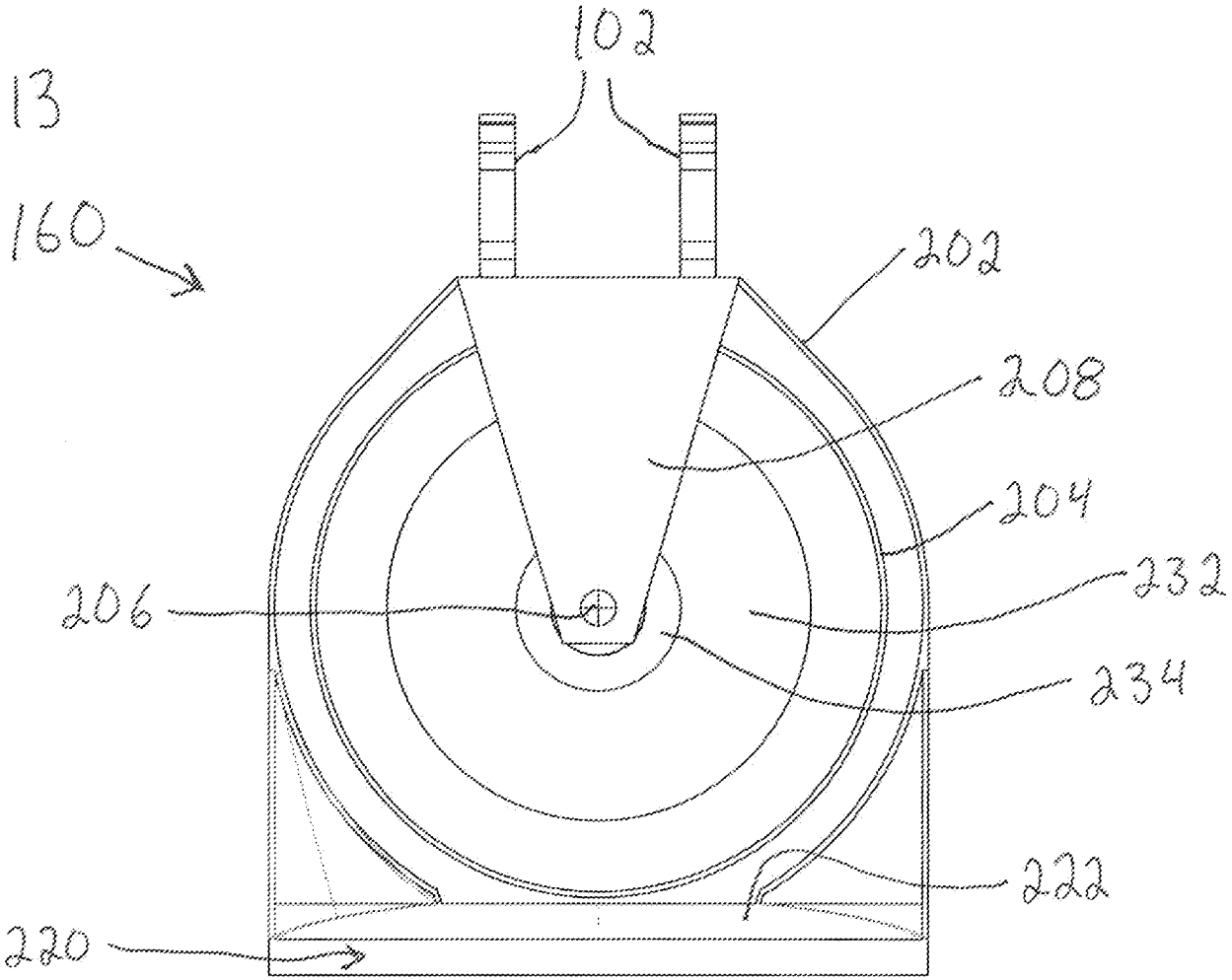
FIG. 13 is a front elevation view of the rotary separator embodiment of FIG. 11.

FIGS. 11 to 13 show a rotary separator 200 embodiment of the present invention configured for attachment to, and articulation with respect to, a digger arm in the same manner as a conventional excavator bucket 100. However, although such configuration may be preferred with respect to the loading and emptying of the rotary separator, it is contemplated that a rotary separator embodiment need not be configured for attachment to an excavator.

The rotary separator 200 includes an outer housing 202, an inner drum 204, a centering shaft 206, a drum support 208 and a drive motor 210 (not to scale).

The outer housing 202 includes a collecting pan 220 and a feed ramp 222. A cowling (not shown) is attached to, or integral with, the outer housing 202 and is located about the opening of the inner drum 204 so as to entry of solids into the space between the inner drum 204 and the outer housing 202.

The inner drum 202 is cylindrical and the cylindrical wall is configured so as to permit passage of liquid 112 while impeding passage of solids. In the drawings this is indicated by perforations 230 in the cylindrical wall of the inner drum 202. To be clear, in the drawings, the size of the perforations 230 is exaggerated for purposes of illustration. In use, the size of the perforations 230 would be determined based on the anticipated solid size in the liquid-solid mixture 114. As well, the perforations 230 may be used with a separate screen or mesh material (not shown) lining, or encircling, the inner drum 204.

The centering shaft 206 includes a curved shoulder 232 and auger projections 234, which, in use, are understood to cooperatively assist in moving material along the length of the centering shaft 206 and thence towards the cylindrical wall of the inner drum 204

In use, liquid-solid mixture 114 is loaded into the inner drum 204 in the same manner as material is typically loaded into conventional excavator bucket 100. The activating the drive motor 210 causes the inner drum 204 to rotate relative to the outer housing 202. The centrifugal force generated through rotation of the inner drum 204 causes liquid 112 to move through the perforations 230, and thence to the collecting pan 220 (either directly or indirectly). The outer housing 202 means for liquid discharge means (not shown) for discharging liquid 112 from the collection pan 220 while retaining the any material within the inner drum 204.

It is understood that, as compared to first bucket separator 120 and second bucket separator 160 embodiments, the utilization of the centrifugal force by the rotary separator embodiment permits use of a finer mesh size.

What is claimed is:

1. An apparatus for use with an excavator for separating liquid from a liquid-solid mixture, the apparatus comprising:

an excavator bucket having a plurality of openings between the bucket interior and the bucket exterior, the openings configured to permit passage of liquid and impede passage of solids; and a pressure pad movable by a user relative to the bucket between an open position in which material may be received into, and removed from, the bucket interior, and a compressing position in which the pressure pad intrudes into the bucket interior, whereby liquid may be separated from a liquid-solid mixture located within the bucket interior, by moving the pressure pad toward the compressing position so as to compress liquid-solid mixture thereby causing liquid to flow through the openings wherein, the apparatus further comprises:

a hydraulic rotary actuator mounted to the excavator bucket, controllable by the user and having an axis of rotation; and one or more pressure pad arms interposed between the hydraulic rotary actuator and the pressure pad, whereby the pressure pad is hingedly connected to the excavator bucket and is movable by the user in an arc about the axis of rotation of the rotary actuator;

the bucket interior includes two opposed side surfaces, an upper surface and a lower surface, each of the upper surface and lower surface curved concentric with the axis of rotation of the rotary actuator:

a gasket is affixed to the pressure pad and in use, the gasket abuts the side surfaces, upper surface and lower surface of the bucket interior through a range of movement in the arc about the axis of rotation of the rotary actuator.

2. The apparatus of claim 1, wherein the pressure pad comprises a vibrator.

3. The apparatus of claim 2, wherein the vibrator is electrically actuated.

4. The apparatus of claim 2, wherein the vibrator is hydraulically actuated.

5. The apparatus of claim 1, wherein the pressure pad includes a plurality of pressure pad openings therethrough configured to permit passage of liquid and impede passage of solids.

6. The apparatus of claim 1, further comprising a screen insert configured to permit passage of liquid while impeding passage of solids, the screen insert spanning the bucket interior wherein the pressure pad moves toward the screen insert when the pressure pad moves toward the compressing position.

7. The apparatus of claim 1, wherein the plurality of openings between the bucket interior and the bucket exterior include openings in two side screens, wherein one of the side screens is in one of the side surfaces and the other of the side screens is in the other of the side surfaces.

8. The apparatus of claim 1, wherein the pressure pad is substantially planar and includes a pad face screen configured to permit passage of liquid through the pressure pad while impeding passage of solids.

9. The apparatus of claim 1, wherein:

the pressure pad is substantially planar and includes a pad face screen configured to permit passage of liquid through the pressure pad while impeding passage of solids; and the plurality of openings between the bucket interior and the bucket exterior include openings in two side screens, wherein one of the side screens is in one of the side surfaces and the other of the side screens is in the other of the side surfaces; and further comprising a screen insert configured to permit passage of liquid while impeding passage of solids, the screen insert spanning the bucket interior wherein the pressure pad moves toward the screen insert when the pressure pad moves toward the compressing position.

10. the apparatus of claim 1, wherein the pressure pad comprises a vibrator.

* * * * *